United States Patent [19]

Tassie

[11] 4,263,837

[45] Apr. 28, 1981

[54] ENDLESS CONVEYOR SYSTEM

[75] Inventor: Douglas P. Tassie, St. George, Vt.

[73] Assignee: General Electric Company, Burlington, Vt.

[21] Appl. No.: 22,763

[22] Filed: Mar. 22, 1979

[51] Int. Cl.[3] ..... F41D 10/14

[52] U.S. Cl. ..... 89/34; 198/655

[58] Field of Search ..... 89/33 BB, 33 BC, 33 C, 89/33 CA, 34, 35 R, 35 A; 198/655

[56] References Cited

U.S. PATENT DOCUMENTS

| | | | |
|---|---|---|---|
| 1,137,543 | 4/1915 | Sergeeff . | |
| 2,357,127 | 8/1944 | North | 89/33 BB |
| 2,489,428 | 11/1949 | Mariner | 89/33 BB |
| 2,849,921 | 9/1958 | Otto | 89/12 |
| 2,997,923 | 8/1961 | Kempton | 89/33 BB |
| 3,101,647 | 8/1963 | Greene | 89/33 BB |
| 3,429,221 | 2/1969 | Kirkpatrick | 89/33 BB |
| 3,612,255 | 10/1971 | Tassie et al. | 198/189 |
| 3,720,301 | 3/1973 | Garland et al. | 198/32 |
| 4,114,511 | 9/1978 | Patenaude | 89/35 R |

FOREIGN PATENT DOCUMENTS

| | | | |
|---|---|---|---|
| 571771 | 3/1933 | Fed. Rep. of Germany . | |
| 581927 | 8/1933 | Fed. Rep. of Germany . | |
| 571430 | 8/1945 | United Kingdom | 89/35 R |

*Primary Examiner*—Stephen C. Bentley
*Attorney, Agent, or Firm*—Bailin L. Kuch

[57] ABSTRACT

This invention has the provision of a magazine having an endless conveyor comprising a plurality of links, each having a respective element for releasably capturing the extractor disk of a cartridge case.

34 Claims, 8 Drawing Figures

90° TURN GENERATION

90° TURN GENERATION

180° TURN GENERATION

ENDLESS CONVEYOR SYSTEM

BACKGROUND OF THE INVENTION

1. Field of the Invention

This invention relates to endless conveyor systems, and particularly to such systems for supplying cartridges to automatic guns.

2. Background of the Invention

Aircraft armament now requires extremely high rates of fire in short or sustained bursts. While the modern Gatling gun of the type first disclosed by H. McC. Otto in U.S. Pat. No. 2,849,921 issued Sept. 2, 1958 is admirably suited to this task, the supplying of cartridges to the gun becomes a more critical limitation as the individual mass and quantity of cartridges to be accelerated and conveyed from the supply of cartridges to the gun is increased.

Typically the cartridges are delivered to the gun either in a linear belt, or in an endless conveyor.

Each cartridge may be supported either on the cylinder of its case or on the base of the case. Linear belts supporting each cartridge on the base of its case are shown by Siemens-Schuckertwerke in German Pat. No. 571,771 issued Mar. 4, 1933; Boulton Paul Aircraft in British Pat. No. 571,430 issued Aug. 24, 1945; J. D. North in U.S. Pat. No. 2,357,127 issued Aug. 29, 1944; G. Sergeeff in U.S. Pat. No. 1,137,543 issued Apr. 27, 1915; and in German Pat. No. 581,927 issued Aug. 5, 1933.

Endless conveyors supporting each cartridge on its cylindrical side are shown by D. P. Tassie in U.S. Pat. No. 3,612,255 issued Oct. 12, 1971; N. C. Garland et al in U.S. Pat. No. 3,720,301 issued Mar. 13, 1973; and R. G. Kirkpatrick in U.S. Pat. No. 3,429,221 issued Feb. 25, 1969.

While the belts with cartridges may be packed in rather close layers, the belts are not adapted to receive and store fired cartridge cases. While the endless conveyors are adapted to receive and store fired cartridge cases, the conveyors are not adapted to packed in rather close layers without end loops.

It is an object of this invention to provide an endless conveyor which may be packed in close layers without large end loops.

It is another object of this invention to provide a conveyor element for receiving the base of a cartridge case and which can be loaded and unloaded automatically.

It is still another object of this invention to provide a magazine, utilizing an endless conveyor, having a minimum of volume and a maximum of simplicity.

A feature of this invention is the provision of a magazine having an endless conveyor comprising a plurality of links, each having a respective element for releasably capturing the extractor disk of a cartridge case.

BRIEF DESCRIPTION OF THE DRAWING

These and other objects, features, and advantages of this invention will be apparent from the following specification thereof taken in conjunction with the accompanying drawing in which.

DESCRIPTION OF THE INVENTION

Figure 1:
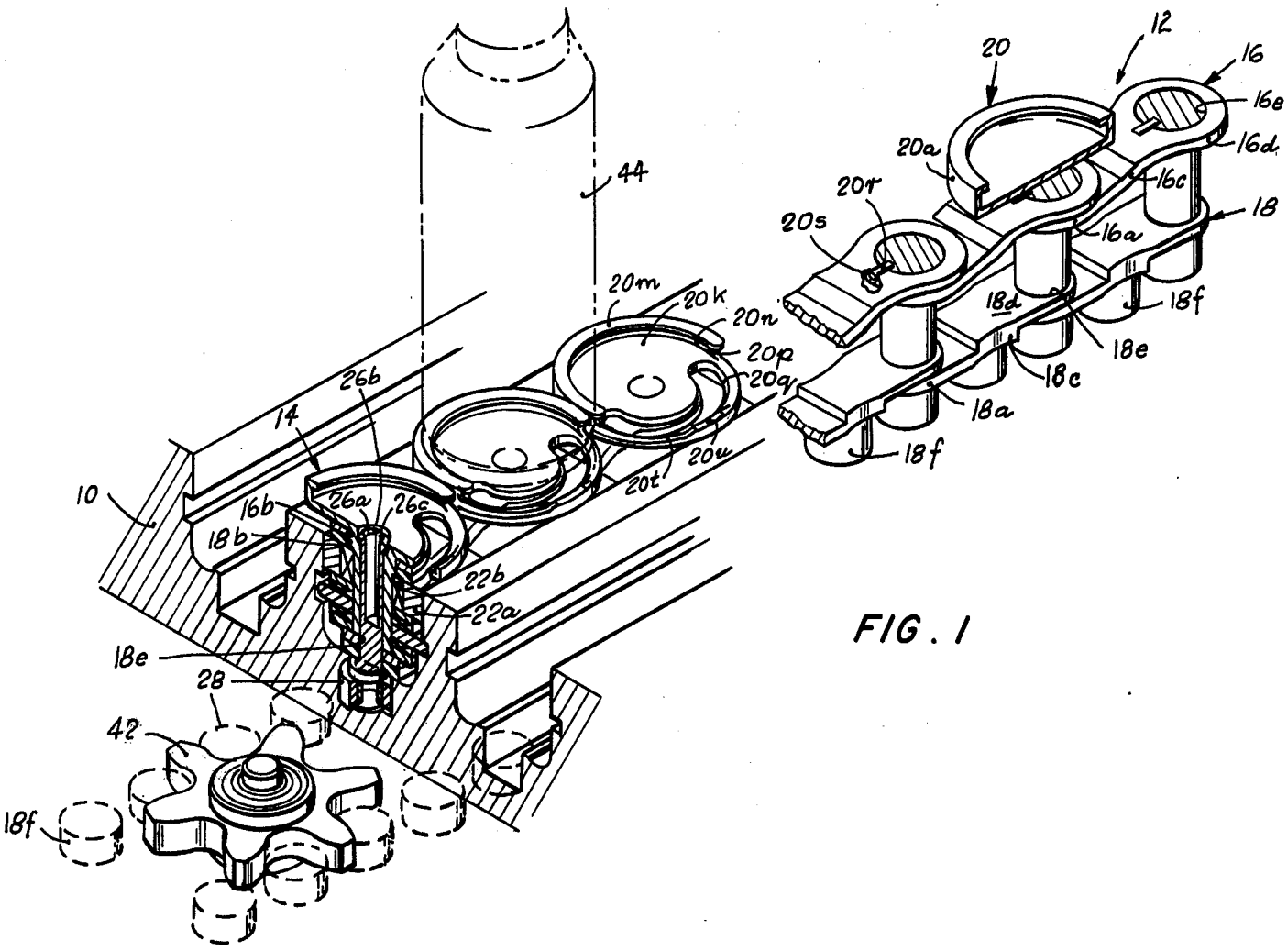
FIG. 1 is a detail perspective view, partially broken away, of a magazine having an endless conveyor embodying this invention.
Figure 2:
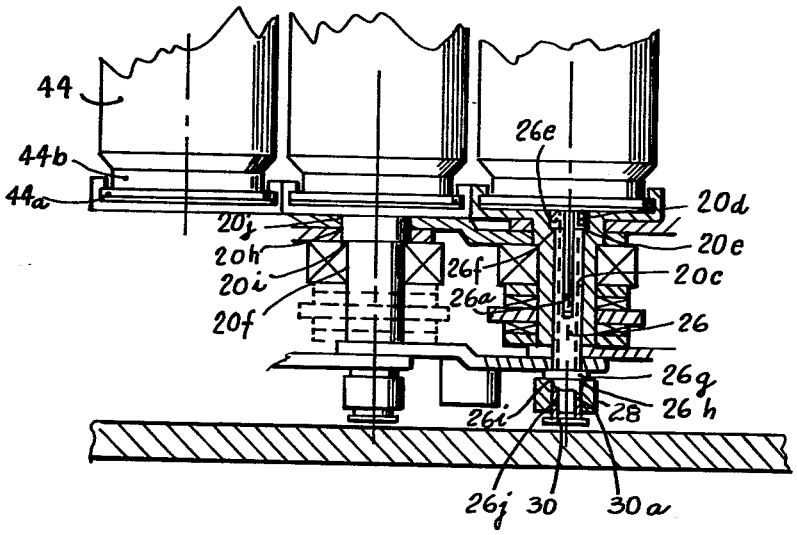
FIG. 2 is a detail side view, in partial cross-section, of the magazine of FIG. 1.
Figure 3:
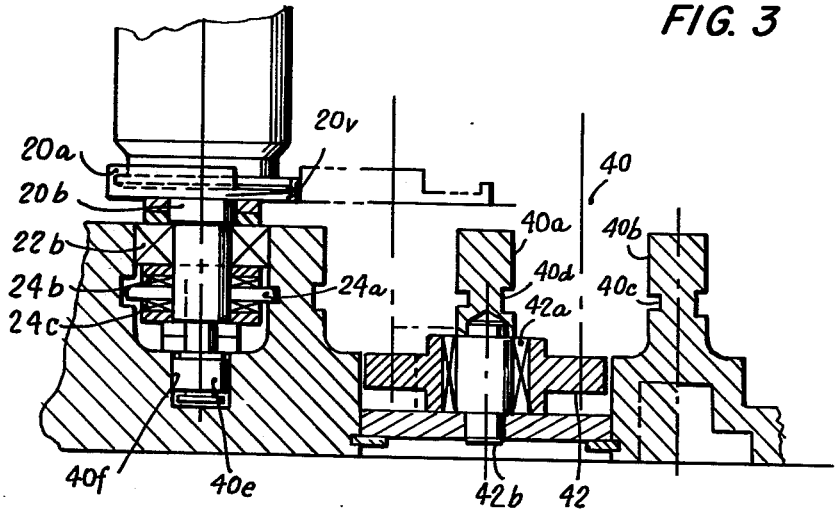
FIG. 3 is a detail end view, in partial cross-section, of the magazine of FIG. 1.

The magazine, as shown in FIG. 1, includes a base 10 and an endless conveyor 12. The conveyor comprises a plurality of identical conveyor units 14, each unit including an upper link 16, a lower link 18, and a cartridge carrier 20.

The carrier includes an upper head portion **20*a* and a lower stem portion 20*b* having an inner bore 20*c* with an inner bore enlargement 20*d* providing a shoulder 20*e*, and an outer lower cylindrical surface 20*f* having a cylindrical enlargement 20*h* providing a shoulder 20*i*, and the underside of the head portion providing a shoulder 20*j*. An upper roller 22*a* is journaled on a needle bearing 22*b* which is fixed on the lower cylindrical surface 20*f* abutting the shoulder 20*i*. A thrust roller 24*a* is journaled on the lower cylindrical surface between an upper needle bearing 24*b* and a lower needle bearing 24*c* which are both fixed on the lower cylindrical surface. A retainer pin 26 having a central bore 26*a*, an upper portion with three spring fingers 26*b* spaced apart by radial slots 26*c* and each terminating in a head portion having an outer, upper camming surface 26*e* and an outer, lower shoulder 26*f*, an integral collar 26*g* providing an upper shoulder 26*h* and a lower shoulder 26*i*, and a lower portion 26*j*. A lower roller 28 is journaled on the lower portion 26*j* and captured against the shoulder 26*i* by a push-in cap 30 having a three fingered stem 30*a* frictionally held in the bore 26*a***.

Each upper link 16 includes a preceding portion **16*a* with a bore 16*b* therethrough, a transitional portion 16*c*, and a trailing portion 16*d* with a bore 16*e*** therethrough and displaced from the plane of the preceding portion of the thickness of the link.

Each lower link 18 includes a preceding portion **18*a* with a bore 18*b* therethrough, a transitional portion 18*c*, and a trailing portion 18*d* with a bore 18*e* therethrough and displaced from the plane of the preceding portion by the thickness of the link. A boss or stud 18*f* extends downwardly from the transitional portion 18*c* and is equidistant between the two bores 18*b* and 18*e*. Each carrier has its stem portion received through the bore 16*a* of a trailing upper link 16 and through the bore 16*e* of the next preceding upper link 16, which are captured between the shoulder 20*j* and the upper roller 22*a*. Each retainer pin 26 is received through the bore 18*a* of a trailing lower link 18 and through the bore 18*e* of the next preceding lower link 18, which are captured between the underside of the stem portion of the carrier and the collar 26*g*** of the retainer pin.

The upper head portion **20*a* of the carrier 20 includes a flat base 20*k* with an integral, semicircular rim 20*m* having an inwardly directed lip 20*n* forming an annular slot 20*p*. A semicircular cutout 20*q* is formed in the base to provide a resilient semicircular element 20*t* having an upstanding tab 20*u* having an inner wall surface which is coplanar with the cylinder defined by the inner wall surface of the rim 20*m***.

A key 20*r* lies in a keyway 20*s* cut into both the upper link 16 and the stem portion 20*b* of the carrier. This key precludes relative rotation between the carrier 20 and the upper link 16.

The base 10 has a plurality of parallel channels 40 formed therein. Each channel includes a pair of spaced apart upper side walls 40*a* and 40*b*, adapted to guide the upper rollers 22*a* along a vertical plane, a narrow lateral groove 40*c* adapted to guide the thrust rollers 24*a* along a horizontal plane, a wide lateral groove 40*d* adapted to clear the thrust rollers 24*a*, and a pair of spaced apart lower side walls 40*e* and 40*f* adapted to guide the lower rollers 28 and the studs 18*f* along a vertical plane. In the arcuate transitions between the parallel channels, the outer wall 40*b* and 40*f* and the outer slot 40*c* are continued, while the inner walls 40*a* and 40*e* and the inner slot 40*d* are omitted.

A sprocket 42 is journaled on a bearing 42*a* and a shaft 42*b* between immediately adjacent parallel channels to engage the lower rollers 28 and studs 18*f* in one channel and drive them in one direction, and to engage the lower rollers 28 and studs 18*f* in the next channel and drive them in the opposite direction.

Each cartridge case 44 has an extractor disk 44*a* which is received into the slot 20*p* of the head of the carrier, with the lip 20*n* entering the extractor groove 44*b* of the case. The tab 20*u* abuts the edge of the extractor disk and captures the disk in the slot. The inner wall of the tab may be provided with a fillet having a cam surface 20*v*. Forceful lateral movement of the cartridge case against the cam surface will deflect the element 20*t* downwardly to withdraw the tab 20*u* to permit the extractor disk to withdraw laterally from the slot. Alternatively, an external, fixed cam surface 46 may be provided in the magazine, under which the top of the tab rides, to deflect the tab downwardly, to permit lateral withdrawal, or lateral entry, of the disk from or into the slot.

Figure 4:
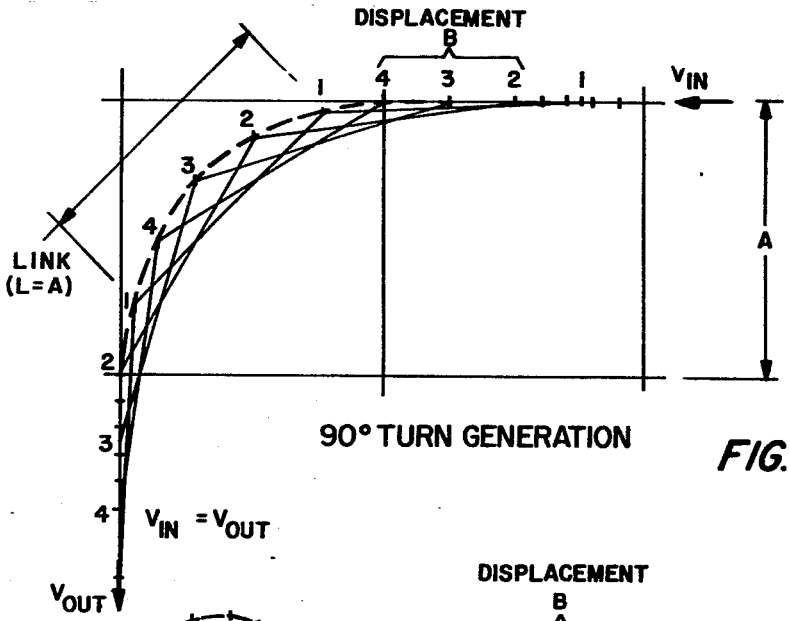
FIG. 4 is a layout of a first 90° turn generation.

A 90° transition of the endless conveyor is shown in FIG. 4. The centers of the carriers 20 define a two dimensional grid which is A by A. The distance L between centers of a link is also equal to A. The entering-into-the-turn-velocity $V^{in}$ of the conveyor is equal to the exiting-from-the-turn-velocity $V^{out}$. However, the exiting carriers are one-half out of phase with the centers of the grid. But two 90° turns in sequence will return the carriers into phase.

Figure 5:
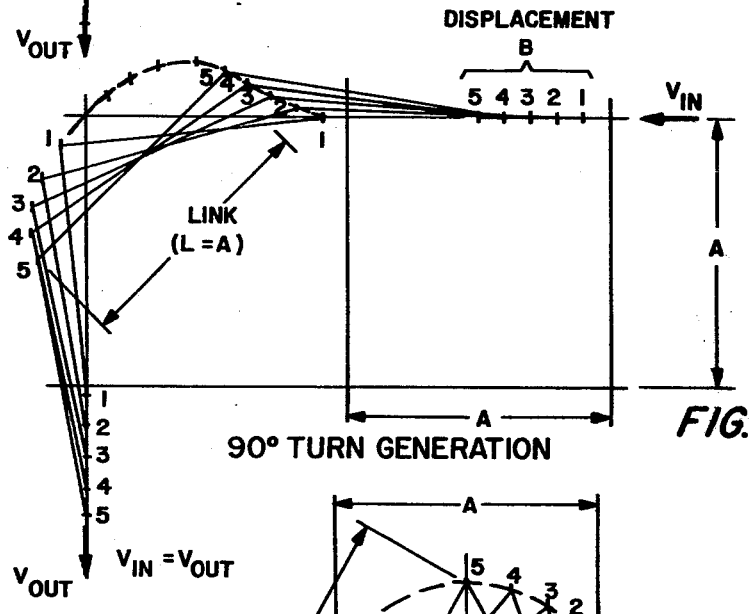
FIG. 5 is a layout of a second 90° turn generation.

A second arrangement of a 90° transition of the endless conveyor is shown in FIG. 5. The entering-into-the-turn-velocity $V^{in}$ of the conveyor is equal to the exiting-from-the-turn-velocity $V^{out}$. The exiting carriers are in phase with the centers of the grid.

Figure 6:
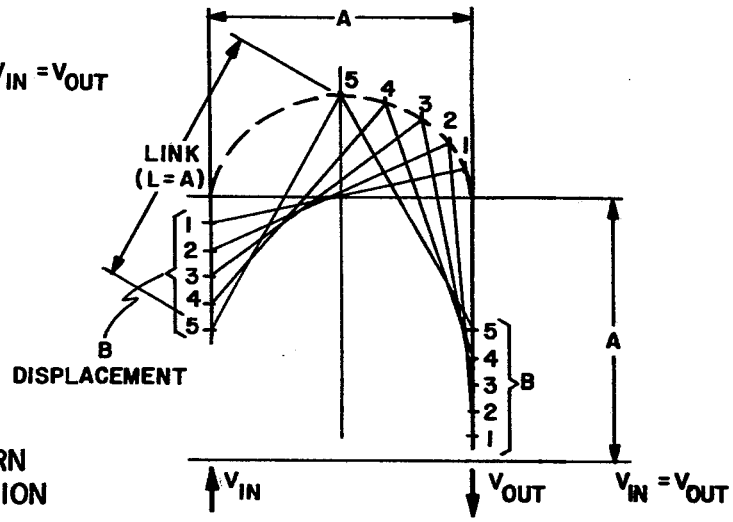
FIG. 6 is a layout of a 180° turn generation.

An arrangement of a 180° transition of the endless conveyor is shown in FIG. 6. The entering-into-the-turn-velocity $V^{in}$ of the conveyors is equal to the exiting-from-the-turn-velocity $V^{out}$. The exiting carriers are in phase with the centers of the grid.

Figure 7:
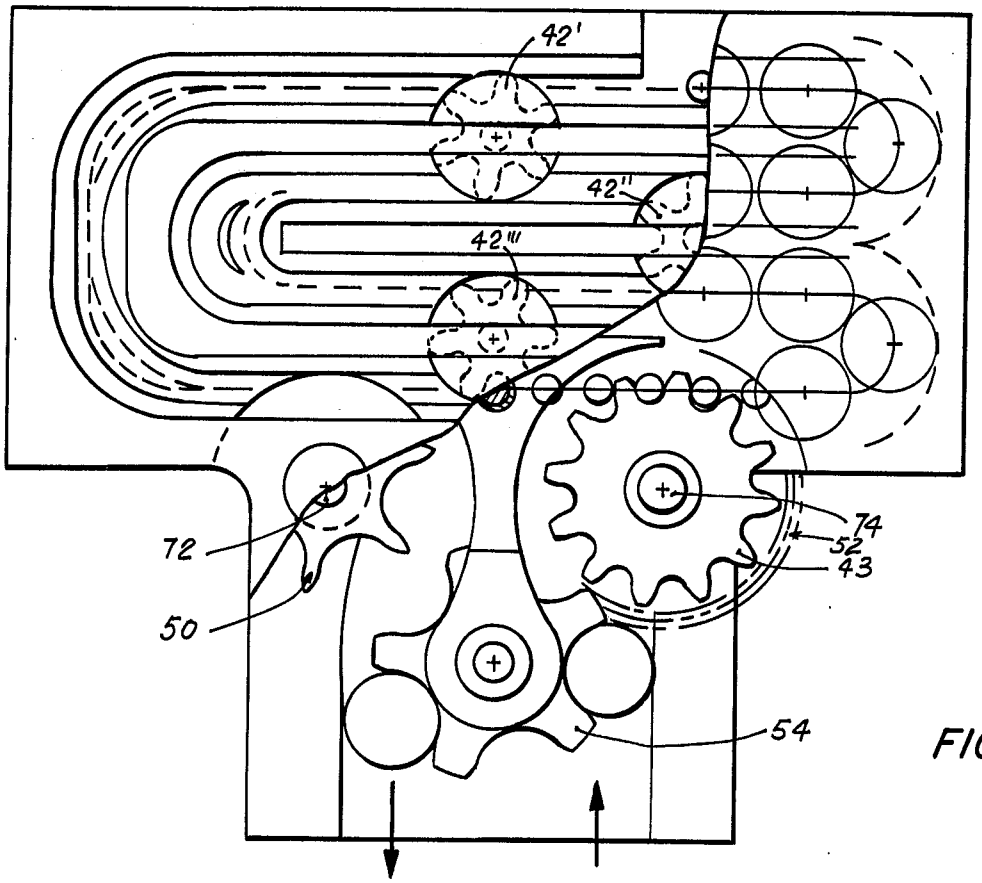
FIG. 7 is a top view, partially broken away, of the magazine of FIG. 1.
Figure 8:
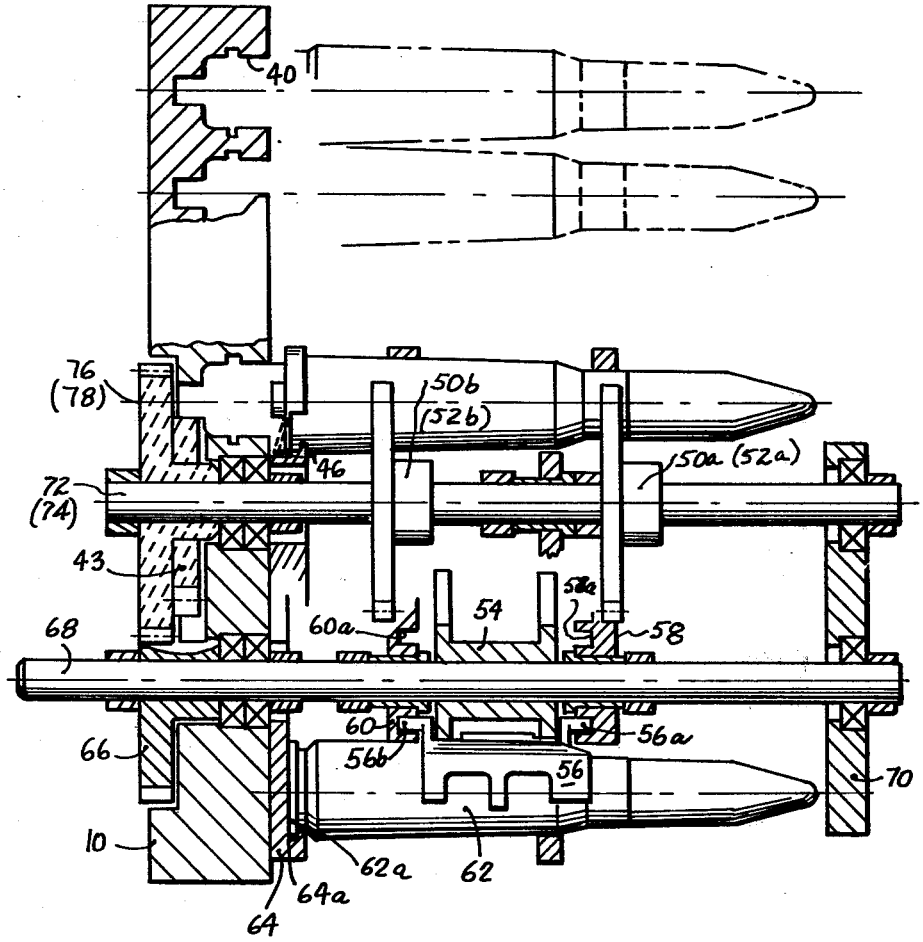
FIG. 8 is a side view, in partial cross-section, of the magazine of FIG. 7.

A four row magazine is shown in FIGS. 7 and 8. The magazine comprises a base plate in which are four parallel channels 40. The second and third channels are connected by a 180° turn. The first and second channels are connected by a 180° turn. The third and fourth channels are connected by a 180° turn. The first and fourth channels are connected by two 90° turns.

The fourth channel has a straight run of conveyor which cooperates with an additional endless conveyor of the type shown in U.S. Pat. No. 3,429,221, mentioned previously, to provide a hand-in and hand-out of rounds or cases.

The hand-in and hand-out functions are provided by a pair of sprockets 50 and 52, and a turnaround sprocket 54 for the additional endless conveyor.

The turnaround sprocket 54 meshes with an endless chain of cradles 56 as shown in U.S. Pat. No. 3,429,221. Each cradle has an upper foot 56*a* which rides in an upper groove 58*a* in a stationary upper guide bar 58, and a lower foot 56*b* which rides in a lower groove 60*a* in a stationary lower guide bar 60. Each cradle is adapted to carry a respective round 62 or case, whose extractor disk 62*a* is guided in the slot 64*a* lower outer rim guide 64. This slot 64*a* is coplanar with the slot 20*p* in the head portion 20*a* of the carrier 20 and opens onto the fourth channel 40. The lower outer rim guide 64 also includes a downwardly facing ramp surface 46 which overlines the upper edge of the tab 20*n*, and as the tab rides under the ramp surface the tab is forced downwardly to unblock the slot 20*p*. The extractor disk can then ride out of the slot 20*p* and into the slot 64*a*, or vice versa. The sprocket 54 and a spur gear 66 is fixed on a shaft 68 which is journaled in a magazine top plate 70 and in the base plate 10.

Each of the sprockets 50 and 52 includes an upper sprocket 50*a* and 52*a* respectively for engaging the necks of the cartridge cases, and a lower sprocket 50*b* and 52*b* respectively for engaging the lower portions of the cases, which are fixed to a respective shaft 72 and 74. The shafts 72 and 74 are respectively journaled in the top plate 70 and the base plate 10, and each has fixed thereto a respective spur gear 76 and 78 which are meshed with the spur gear 66 and driven thereby. The shafts 72 and 74 also have fixed thereto a respective sprocket 43 for respectively driving the rollers 28 and the studs 18*f*.

A sprocket 42' is disposed between and meshed with the rollers and the studs of the first and second conveyor runs. A sprocket 42'' is disposed between and meshed with the rollers and the studs of the second and third conveyor runs. A sprocket 42''' is disposed between and meshed with the rollers and the conveyors of the third and fourth conveyor runs. The sprockets 42', 42'' and 42''' are driven by the sprocket 43 via the conveyor 12.

I claim:

1. A magazine, for rounds of ammunition, each round having a case with an extractor disk and an extractor groove comprising:

a support means providing a channel;

an endless conveyor disposed in said channel and formed of a plurality of carriers intercoupled in sequence;

each carrier including link means, carrier means for releasably seizing and supporting the case of a round of ammunition, for intercoupling immediately adjacent link means, and for capturing and supporting said conveyor in said channel;

each of said carrier means including a head portion having a circular base subportion and an annular upstanding rim subportion, said rim subportion having a semicircular rigid portion having an inwardly directed lip forming an annular slot, said base and slot adapted to receive the extractor disk of a case and said lip adapted to enter the extractor groove of such case, and a resilient portion having an upstanding tab for blocking entrance and exit of an extractor disk to and from said slot of said semicircular rigid portion, said base subportion including an arcuate cut therein adjacent said upstanding tab whereby to provide for resilient movement of said tab with respect to said semicircular rigid portion.

2. A magazine according to claim 1 further including:

means for displacing said upstanding tab to unblock entrance and exit of an extractor disk to and from said slot of said semicircular rigid portion.

3. A magazine according to claim 2 wherein:

said displacing means comprises a cam surface formed in said channel for overriding and deflecting said tab out of the plane of said slot.

4. A magazine according to claim 1 wherein:

said channel includes a laterally extending groove, and said carrier means includes a thrust bearing extending into said laterally extending groove.

5. A magazine according to claim 1 wherein:

each of said carrier means includes pivot means, fixed to said head portion and to said link means for pivotally intercoupling said disk means with the next adjacent link means.

6. A magazine according to claim 5 further including:

conveyor driving means;

said pivot means includes first means to be engaged and driven by said conveyor driving means, and said link means includes second means to be engaged and driven by said conveyor driving means.

7. A magazine according to claim 1 wherein:

said magazine includes a plurality of parallel channels, the spacing between the central planes of immediately adjacent ones of said channels being equal to the spacing between the axes of immediately adjacent ones of said carrier means.

8. A magazine according to claim 2 further including:

means for handing-in a round of ammunition to said head portion when said tab is displaced.

9. A magazine according to claim 2 further including:

means for handing-out a round of ammunition to said head portion when said tab is displaced.

10. A store for articles, each article having a base disk and a groove thereabove, comprising:

a support means providing a channel;

an endless conveyor disposed in said channel and formed of a plurality of carriers intercoupled in sequence;

each carrier including link means, carrier means for releasably seizing and supporting the base disk of an article, for intercoupling immediately adjacent link means, and for capturing and supporting said conveyor in said channel, each of said carrier means includes a head portion having a circular base subportion and an annular upstanding rim subportion, said rim subportion having a semicircular rigid portion having an inwardly directed lip forming an annular slot, said base and slot adapted to receive the extractor disk of a case and said lip adapted to enter the extractor groove of such case, a resilient portion having an upstanding tab for blocking entrance and exit of an extractor disk to and from said slot of said semicircular rigid portion, said base subportion includes an arcuate cut therein adjacent said upstanding tab whereby to provide for resilient movement of said tab with respect to said semicircular rigid portion.

11. A store according to claim 10 further including:

means for displacing said upstanding tab to unblock entrance and exit of an extractor disk to and from said slot of said semicircular rigid portion.

12. A store according to claim 11 wherein:

said displacing means comprises a cam surface formed in said channel for overriding and deflecting said tab out of the plane of said slot.

13. A store according to claim 10 wherein:

said channel includes a laterally extending groove, and said carrier means includes a thrust bearing extending into said laterally extending groove.

14. A store according to claim 10 wherein:

each of said carrier means includes pivot means, fixed to said head portion and to said link means for pivotally intercoupling said disk means with the next adjacent link means.

15. A store according to claim 14 further including:

conveyor driving means;

said pivot means includes first means to be engaged and driven by said conveyor driving means, and said link means includes second means to be engaged and driven by said conveyor driving means.

16. A store according to claim 10 wherein:

said magazine includes a plurality of parallel channels, the spacing between the central planes of immediately adjacent ones of said channels being equal to the spacing between the axes of immediately adjacent ones of said carrier means.

17. A magazine, for rounds of ammunition, each round having a case with an extractor disk and an extractor groove comprising:

a support means providing a channel;

an endless conveyor disposed in said channel and formed of a plurality of carriers intercoupled in sequence;

each carrier including link means, carrier means for releasably seizing and supporting the case of a round of ammunition, for intercoupling immediately adjacent link means, and for capturing and supporting said conveyor in said channel, each of said carrier means having a longitudinal axis and including a head portion having a circular base subportion and an annular upstanding rim subportion, said rim subportion having a semicircular rigid portion having an inwardly directed lip forming an annular slot lying in a plane normal to said longitudinal axis, said base and slot adapted to receive the extractor disk of a case and said lip adapted to enter the extractor groove of such case, a resilient portion having an upstanding tab for blocking entrance and exit of an extractor disk to and from said slot of said semicircular rigid portion, said tab having limited movement along a path which is parallel to said longitudinal axis.

18. A magazine according to claim 17 wherein:

said base subportion includes a cut therein adjacent said upstanding tab whereby to provide for resilient movement of said tab with respect to said semicircular rigid portion.

19. A magazine according to claim 17 further including:

means for displacing said upstanding tab to unblock entrance and exit of an extractor disk to and from said slot of said semicircular rigid portion.

20. A magazine according to claim 19 wherein:

said displacing means comprises a cam surface formed in said channel for overriding, engaging and deflecting said tab out of the plane of said slot.

21. A magazine according to claim 17 wherein:

said channel includes a laterally extending groove, and said carrier means includes a thrust bearing extending into said laterally extending groove.

22. A magazine according to claim 17 wherein:

each of said carrier means includes pivot means, fixed to said head portion and to said link means for pivotally intercoupling said disk means with the next adjacent link means.

23. A magazine according to claim 22 further including:

conveyor driving means;

said pivot means includes first means to be engaged and driven by said conveyor driving means, and said link means includes second means to be engaged and driven by said conveyor driving means.

24. A magazine according to claim 17 wherein:

said magazine includes a plurality of parallel channels, the spacing between the central planes of immediately adjacent ones of said channels being equal to the spacing between the axes of immediately adjacent ones of said carrier means.

25. A magazine according to claim 19 further including:

means for handing-in a round of ammunition to said head portion when said tab is displaced.

26. A magazine according to claim 19 further including:

means for handing-out a round of ammunition to said head portion when said tab is displaced.

27. A store for articles, each article having a base disk and a groove thereabove, comprising:

a support means providing a channel, an endless conveyor disposed in said channel and formed of a plurality of carriers intercoupled in sequence;

each carrier including link means, carrier means for releasably seizing and supporting the base disk of an article, for intercoupling immediately adjacent link means, and for capturing and supporting said conveyor in said channel, each of said carrier means includes a head portion having a circular base subportion and an annular upstanding rim subportion, said rim subportion having a semicircular rigid portion having an inwardly directed lip forming an annular slot lying in a plane normal to said longitudinal axis, and base and slot adapted to receive the extractor disk of a case and said lip adapted to enter the extractor groove of such case, a resilient portion having an upstanding tab for blocking entrance and exit of an extactor disk to and from said slot of said semicircular rigid portion, said tab having limited movement along a path which is parallel to said longitudinal axis.

28. A store according to claim 27 wherein:

said base subportion includes a cut therein adjacent said upstanding tab whereby to provide for resilient movement of said tab with respect to said semicircular rigid portion.

29. A store according to claim 27 further including:

means for displacing said upstanding tab to unblock entrance and exit of an extractor disk to and from said slot of said semicircular rigid portion.

30. A store according to claim 27 wherein:

said displacing means comprises a cam surface formed in said channel for overriding and deflecting said tab out of the plane of said slot.

31. A store according to claim 27 wherein:

said channel includes a laterally extending groove, and said carrier means includes a thrust bearing extending into said laterally extending groove.

32. A store according to claim 27 wherein:

each of said carrier means includes a head portion for receiving the base disk of an article, and pivot means, fixed to said head portion and to said link means for pivotally intercoupling said disk means with the next adjacent link means.

33. A store according to claim 32 further including:

conveyor driving means;

said pivot means includes first means to be engaged and driven by said conveyor driving means, and said link means includes second means to be engaged and driven by said conveyor driving means.

34. A store according to claim 27 wherein:

said magazine includes a plurality of parallel channels, the spacing between the central planes of immediately adjacent ones of said channels being equal to the spacing between the axes of immediately adjacent ones of said carrier means.

* * * * *